US009303467B2

(12) United States Patent
Otten et al.

(10) Patent No.: US 9,303,467 B2
(45) Date of Patent: Apr. 5, 2016

(54) TOP-TENSIONED RISER SYSTEM

(71) Applicant: Seahorse Equipment Corp, Houston, TX (US)

(72) Inventors: Jeffrey Douglas Otten, Cypress, TX (US); Peimin Cao, Sugar Land, TX (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

(21) Appl. No.: 13/934,801

(22) Filed: Jul. 3, 2013

(65) Prior Publication Data

US 2014/0010597 A1 Jan. 9, 2014

Related U.S. Application Data

(60) Provisional application No. 61/667,549, filed on Jul. 3, 2012, provisional application No. 61/679,303, filed on Aug. 3, 2012.

(51) Int. Cl.
*E21B 19/00* (2006.01)

(52) U.S. Cl.
CPC ..... *E21B 19/004* (2013.01)

(58) Field of Classification Search
CPC ..... E21B 19/004; E21B 19/006
USPC ..... 405/258.1, 259.1, 272, 278, 302.3
See application file for complete search history.

(56) References Cited

U.S. PATENT DOCUMENTS 2,656,182 A 10/1953 Willison
3,605,415 A * 9/1971 Mohlman ..... E21B 19/004 114/264
4,068,864 A * 1/1978 Herbert et al. ..... 285/49
4,733,991 A 3/1988 Myers
4,883,387 A 11/1989 Myers et al.
5,020,942 A * 6/1991 Pallini, Jr. ..... 405/224
5,163,513 A 11/1992 Chancey
5,310,007 A 5/1994 Parikh
5,951,061 A 9/1999 Arlt, III et al.
7,588,393 B1 9/2009 Shivers, III et al.

(Continued)

FOREIGN PATENT DOCUMENTS

WO 2012044928 A2 4/2012

OTHER PUBLICATIONS

F.H. MacPhaiden et al., "Riser Tensioners for a TLP Application", presented at the 17th annual Offshore Technology Conference in Houston, Texas, May 6-9, 1985, (OTC 4985).

*Primary Examiner* — Tara M. Pinnock
(74) *Attorney, Agent, or Firm* — Blank Rome LLP

(57) ABSTRACT

A top-tensioned riser (TTR) is supported by a tensioning system on the deck of a floating platform. The tension ring may include an elastomeric layer which permits small angular and lateral displacements of the tension joint. The tension joint comprises a tapered section to resist the bending moment and shear imposed by the vessel's motion. The riser tension joint may be supported laterally by rollers below the tension ring. The rollers react on the tapered section when the riser strokes up and down. The tapered section may be engineered to maximize the use of the tension joint, and to reduce bending moment and shear loads imposed on the tensioning system. In certain embodiments, there may be a small gap between the rollers and the tapered section. In certain other embodiments, the rollers may be spring-loaded to increase the stability of surface equipment on the upper terminus of the riser.

9 Claims, 7 Drawing Sheets

(56) References Cited

U.S. PATENT DOCUMENTS

| | | | | |
|---|---|---|---|---|
| 7,632,044 | B2 | 12/2009 | Pallini et al. | |
| 7,654,327 | B1 | 2/2010 | Shivers et al. | |
| 8,021,081 | B2 | 9/2011 | Crotwell et al. | |
| 8,123,438 | B2 | 2/2012 | Pallini et al. | |
| 2007/0258775 | A1 | 11/2007 | Murray et al. | |
| 2012/0201611 | A1* | 8/2012 | Flores et al. | 405/224.4 |
| 2012/0292042 | A1 | 11/2012 | Trent | |

* cited by examiner

FIG. 2D
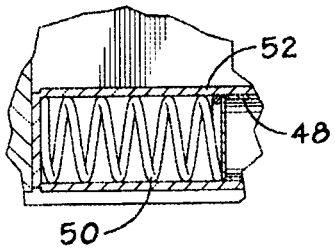
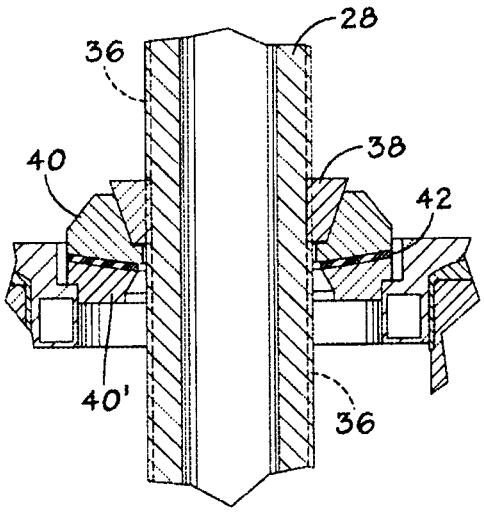
FIG. 2E
FIG. 2C
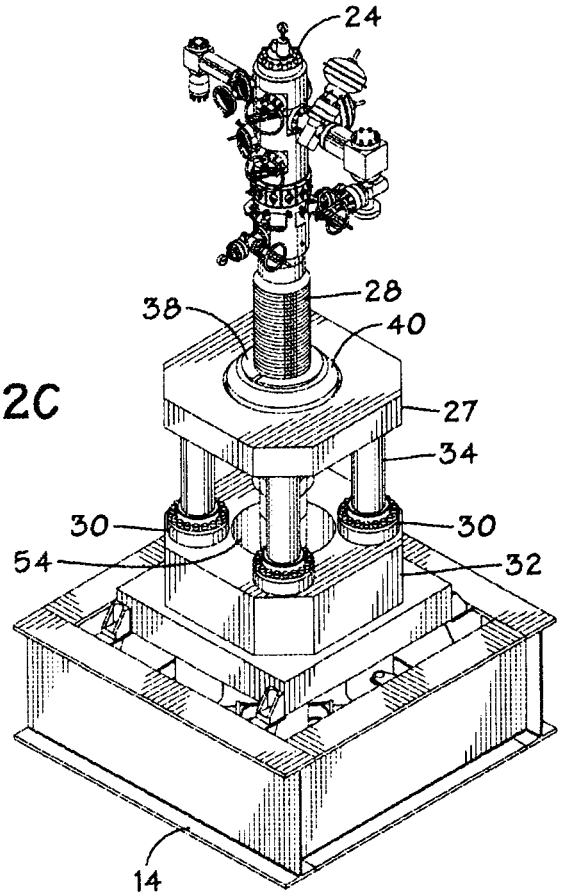

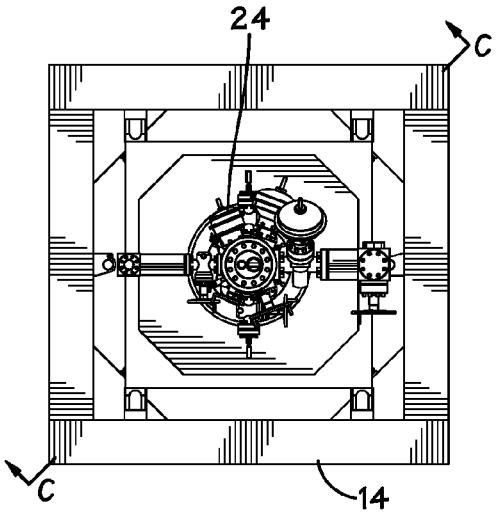
FIG. 4C
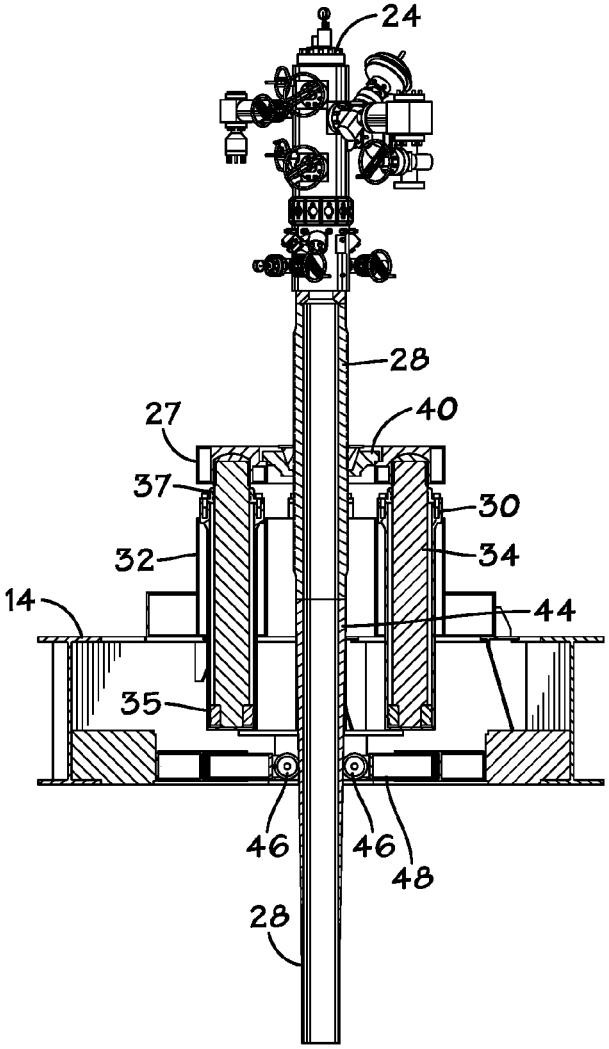

TOP-TENSIONED RISER SYSTEM

CROSS-REFERENCE TO RELATED APPLICATIONS

This application claims the benefit of U.S. Provisional Application No. 61/667,549, filed on Jul. 3, 2012, and U.S. Provisional Application No. 61/679,303, filed on Aug. 3, 2012.

STATEMENT REGARDING FEDERALLY SPONSORED RESEARCH OR DEVELOPMENT

Not Applicable

BACKGROUND OF THE INVENTION

1. Field of the Invention

This invention relates to offshore platforms for oil and gas exploration and production. More particularly, it relates to vertical risers used on such facilities to connect to wellheads on the seafloor.

2. Description of the Related Art Including Information Disclosed Under 37 CFR 1.97 and 1.98.

Conduits are needed to transfer materials from the seafloor to production and drilling facilities atop the water's surface, as well as from the facility to the seafloor. Subsea risers are a type of pipeline developed for this type of vertical transportation. Whether serving as production or import/export vehicles, risers are the connection between the subsea field developments and production and drilling facilities.

There are a number of types of risers, including attached risers, pull tube risers, steel catenary risers, top-tensioned risers, riser towers and flexible riser configurations, as well as drilling risers.

A top-tensioned riser is a vertical riser system that terminates at or near a point on the seafloor directly below the facility. Top-tensioned risers are often used on TLPs and spars. Although moored, these floating facilities are able to move laterally with the wind and waves. Because the rigid risers are fixed to the seafloor, such movement causes vertical displacement between the top of the riser and its connection point on the facility. There are two solutions for this issue. A motion compensator can be included in the top-tensioning riser system that keeps constant tension on the riser by expanding and contracting with the movements of the facility. Alternatively, buoyancy cans, can be deployed around the outside of the riser to keep it afloat. Then the top of the rigid vertical top-tensioned riser is connected to the facility by flexible pipe, which is better able to accommodate the movements of the facility.

U.S. Pat. No. 4,733,991 to Myers describes an adjustable riser top joint for connecting an offshore subsurface well to a deck-mounted welltree. A first plurality of generally annular protrusions on the riser top joint section affords a plurality of connecting points for the wellhead tree using either a unitary or a split collar type attachment. A second plurality of protrusions positioned below deck afford a second plurality of connecting points for riser tensioning means that may also, preferably, be attached using either a unitary or a split collar. The generally annular protrusions are formed as a continuous spiral groove on an external surface of the riser section in a first embodiment and as a series of generally cylindrical protrusions of equal length and spacing in a second embodiment.

PCT Publication No. WO 2012044928 entitled "Riser System for a Slacked Moored Hull Floating Unit" describes a riser tensioning system with an individual riser unit on an oil or gas platform. The platform has a traveling trolley structure with at least one trolley bearing and a centralizer. The trolley bearing is coupled to at least one guide rail configured to allow vertical movement of said traveling trolley structure. The traveling trolley structure is coupled to a riser collar configured to support a top of the riser. The riser tensioning system has at least one cylinder coupled to the traveling trolley structure on one end and secured on an opposite end such that the cylinder is adapted to push or pull the traveling trolley structure vertically.

U.S. Pat. No. 8,021,081 describes a tensioner system for a top-tensioned riser in a floating platform that includes a hydro-pneumatic tensioner assembly resiliently mounted to the floating platform, and a riser support conductor surrounding the riser coaxially, wherein the support conductor conveys a pull-type tensional force from the hydro-pneumatic tensioner assembly to the riser through a riser conductor coupling assembly that engages the tensioner assembly and the riser support conductor to convey the tensional force. A riser tension joint support assembly conveys the tensional force from the riser support conductor to a riser tension joint on the riser. The tensioner assembly compensates for relative platform motion including pitch, heave, and yaw. Also a reactive load assembly is mounted to the platform and reacts to a two-point dynamic bending moment imposed on the riser support conductor, while resisting riser support conductor rotation.

U.S. Pat. No. 7,588,393 describes a method for supporting top-tensioned drilling and production risers on a floating vessel using a tensioner assembly above the waterline of the vessel. The method can include attaching at least one hydraulic cylinder on a first end to a first position on a floating vessel and on a second end to a tension frame below the first position. The next step of the method can be forming a fluid connection between the at least one hydraulic cylinder and at least one primary accumulator.

U.S. Pat. No. 7,654,327 describes a tensioner assembly for moveably carrying a conductor that communicates from a wellhead to a piece of well access equipment on a rig. The tensioner assembly includes a support frame, at least one hydraulic cylinder connected to the support frame, and at least one primary accumulator in fluid communication with the hydraulic cylinder.

U.S. Publication No. 2007/0258775 describes a means for applying a controlled tension to a top tension riser on a floating offshore structure. A mechanical tensioner device and a buoyancy can are combined to apply controlled tension to an individual riser or group of risers supported by a floating offshore structure. The buoyancy can applies static tension force on the riser(s). The mechanical tensioner applies additional tension force to assist the can in limiting the stroke of the riser as the supporting structure is displaced from its nominal position.

U.S. Publication No. 2012/0292042 describes a ram tensioner system with a deck mountable frame having an upper portion and a lower portion connected by a plurality of cylinder sleeves and at least one guide post sleeve. A guide post engages the guide post sleeves and an individually replaceable modular cylinder is in each cylinder sleeve along with at least one individually removable seal gland that is lubricated by a hydraulic power unit, and a slidable rod engaging each of the cylinders. The slidable rods can be attached to the tension deck with a tension ring to engage a riser and provide movable tension to the riser.

U.S. Pat. No. 7,632,044 to Pallini et al. describes a ram style tensioner with a fixed conductor and a floating frame. The riser tensioner for an offshore floating platform has a frame stationarily mounted to the upper portion of the riser. Pistons and cylinders are spaced circumferentially around the riser and connected between the frame and the floating platform. A tubular guide member is mounted to the floating platform for movement in unison in response to waves and currents. The riser extends through the guide member. A guide roller support is mounted to and extends downward from the frame around the guide member. At least one set of guide rollers is mounted to the guide roller support in rolling engagement with the guide member as the guide member moves in unison with the platform.

U.S. Pat. No. 8,123,438 to Pallini et al. describes a ram-style riser tensioner that includes a frame configured to be fixedly attached to the riser; plural cylinder assemblies spaced around the riser, each cylinder assembly having a cylinder and a piston configured to slidably move inside the cylinder, the piston being configured to connect to the frame; a guide roller support stationarily mounted to and extending from the frame; at least one bearing fixedly attached to the guide roller support; and a guide member configured to be in rolling engagement with the at least one bearing as the cylinder moves relative to the frame.

A paper entitled *Riser Tensioners for a TLP Application* by F. H. MacPhaiden and J. P. Abbot presented at the 17$^{th}$ Annual Offshore Technology Conference in Houston, Tex., May 6-9, 1985, (OTC 4985) describes ram-type production and drilling riser tensioners which include a support structure that transmits the tension loads to the platform, ram-accumulator assemblies that generate the required forces needed for tensioning the riser, an upper support ring that acts as an interface between the hydraulic rams and the riser string, retractable latches that provide a suitable landing shoulder for the riser tension sub, and guide rails that transmit horizontal and torsional riser loads into the platform.

BRIEF SUMMARY OF THE INVENTION

A top-tensioned riser (TTR) according to the invention is supported by a ram-type tensioning system on the deck of a floating platform. The riser tension joint is supported laterally by rollers below the tension ring. The tension joint comprises a tapered section to resist the bending moment and shear imposed by the vessel's motion. The rollers react on the tapered section when the riser strokes up and down. The tapered section may be engineered to maximize the use of a tension joint, and to reduce the bending moment and shear loads imposed on the tensioning system. In certain embodiments, there may be a small gap between the rollers and the tapered section. In certain other embodiments, the rollers may be spring loaded to increase stability of the surface equipment.

BRIEF DESCRIPTION OF THE SEVERAL VIEWS OF THE DRAWING(S)

FIG. 2C is a perspective view of the top-tensioned riser shown in FIG. 2A.

FIG. 2D is a detail view of the portion indicated in FIG. 2B.

FIG. 2E is a detail view of the portion indicated in FIG. 2B.

FIG. 4C shows top plan and sectional views of an embodiment of the invention with the production riser tensioner rams in the fully retracted position.

DETAILED DESCRIPTION OF THE INVENTION

Figure 1:
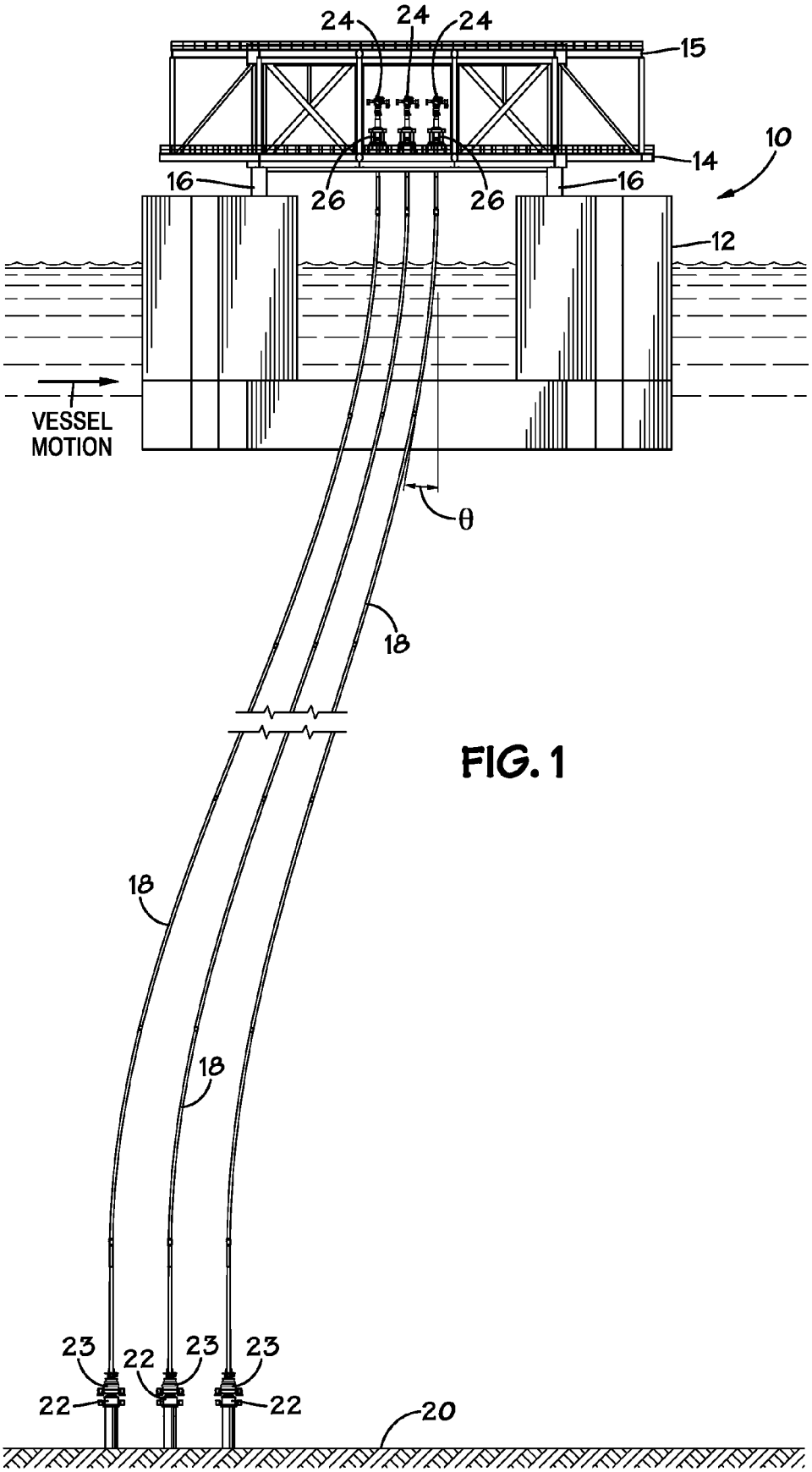
FIG. 1 shows a dry-tree, offshore vessel displaced from its nominal position and the resulting angle θ of subsea risers connecting wellheads on the seafloor to surface equipment mounted on the vessel.

The invention may best be understood by reference to the exemplary embodiments illustrated in the drawing figures.

FIG. 1 shows floating offshore vessel 10 (e.g., a semi-submersible or a tension leg platform) comprising a hull 12 supporting a deck structure 14,15 above the water surface on deck supports 16. A plurality of "Christmas trees" 24 ("trees," "surface production trees," or "surface equipment") are supported on lower deck 14 of vessel 10. In drilling applications, trees 24 may comprise a set of valves, spools and fittings connected to the top of a well to direct and control the flow of formation fluids from the well. A blowout preventer may also be included. In production or well completion applications, surface equipment 24 comprises an assembly of valves, spools, pressure gauges and chokes fitted to the wellhead of a completed well to control production. Surface production trees 24 are available in a wide range of sizes and configurations, such as low- or high-pressure capacity and single- or multiple-completion capacity.

The offshore vessel 10 depicted in FIG. 1 is a so-called "dry-tree vessel"—i.e., the Christmas trees (or "surface equipment") are mounted above the water surface on the upper end of substantially vertical risers 18 which extend to subsea wellheads 22 on seafloor 20. This arrangement facilitates work on the well(s), but usually requires the use of heave compensators in order to maintain a substantially constant tension on the subsea risers 18 due to motion of the vessel 10 at the surface of the sea.

FIG. 1 shows vessel 10 displaced from its nominal position over the subsea wellheads 22 (as might occur due to ocean currents or wind acting on the vessel) and the resulting angle 8 of the subsea risers 18 connecting the wellheads 22 on the seafloor 20 to surface equipment 24 mounted on the vessel. As will be appreciated by those skilled in the art, such displacement imposes a side load on the riser tensioners 26 which can be difficult to accommodate. In the past, dry-tree offshore vessels were often equipped with "keel joints" through which the risers passed in order to vertically align the risers above the water surface and thereby relieve the side loads imposed on the tensioners.

In a compression-type or "push-up" tensioner 26, a plurality of hydraulic cylinders 30 are arrayed around a riser tension joint 28. Piston rods or hydraulic rams 34 extend from the upper ends of the cylinders 30 and engage a tension ring 40 connected to the riser tension joint 28. In certain embodiments, the piston rods or rams have a central cavity open to the interior of the cylinder. This increases the interior volume available for a compressed gas which energizes the tensioner.

In certain other embodiments, the hydraulic cylinders 30 may be in fluid communication with an externally-mounted hydraulic accumulator.

Figure 2A:
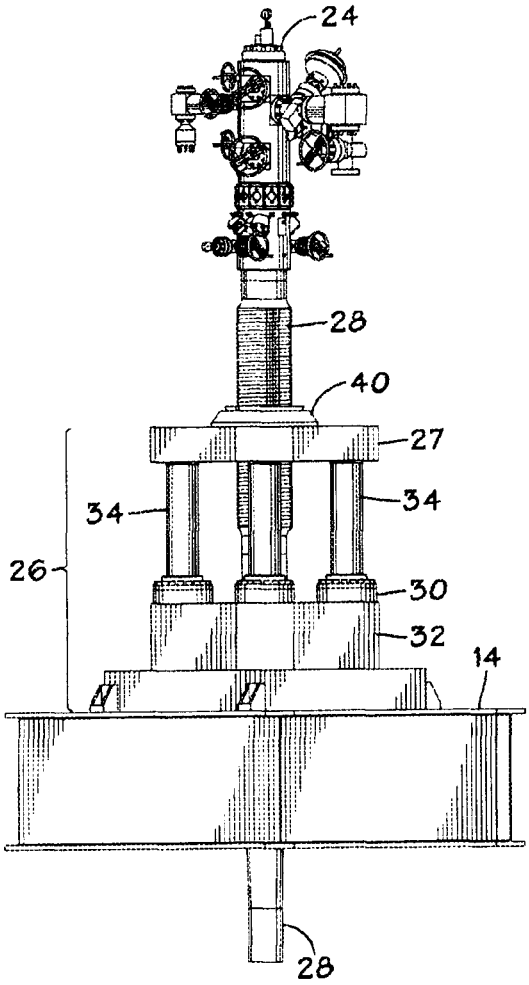
FIG. 2A is a side view of a top-tensioned riser according to one embodiment of the invention.
Figure 2B:
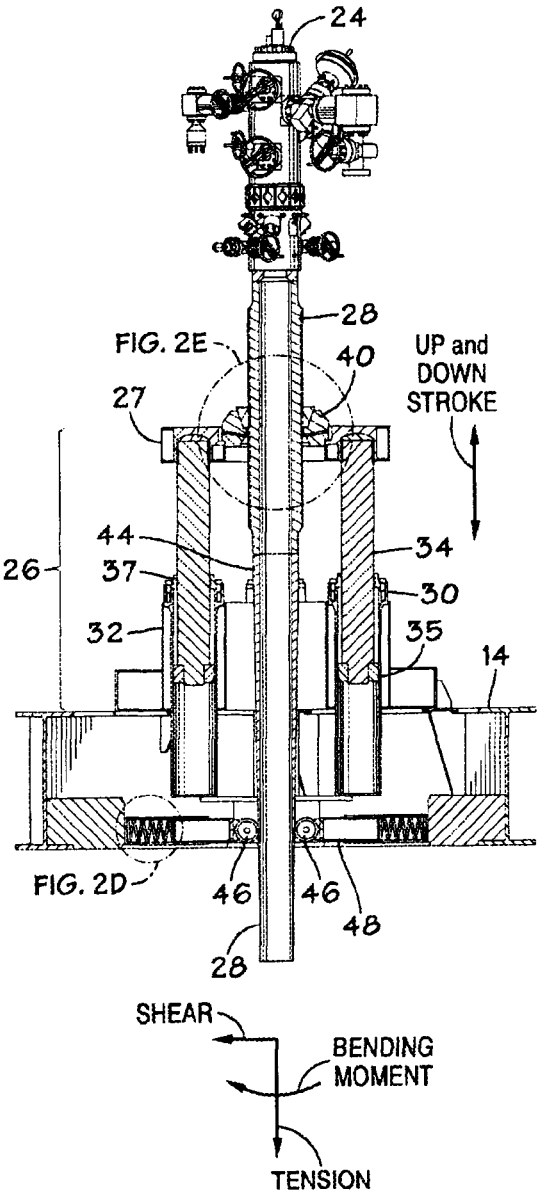
FIG. 2B is a cross-sectional view of the top-tensioned riser shown in FIG. 2A.
Figure 3A:
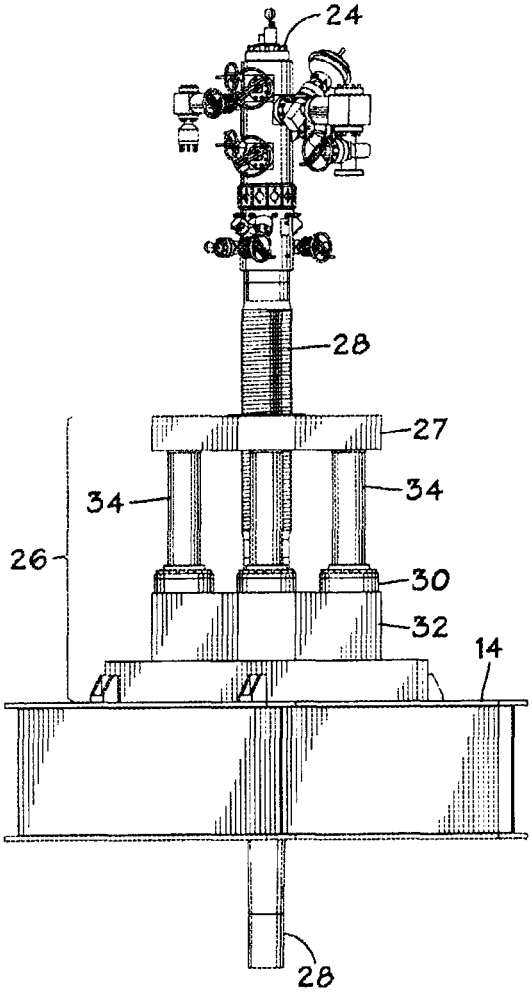
FIG. 3A is a side view of a top-tensioned riser according to a second embodiment of the invention.
Figure 3B:
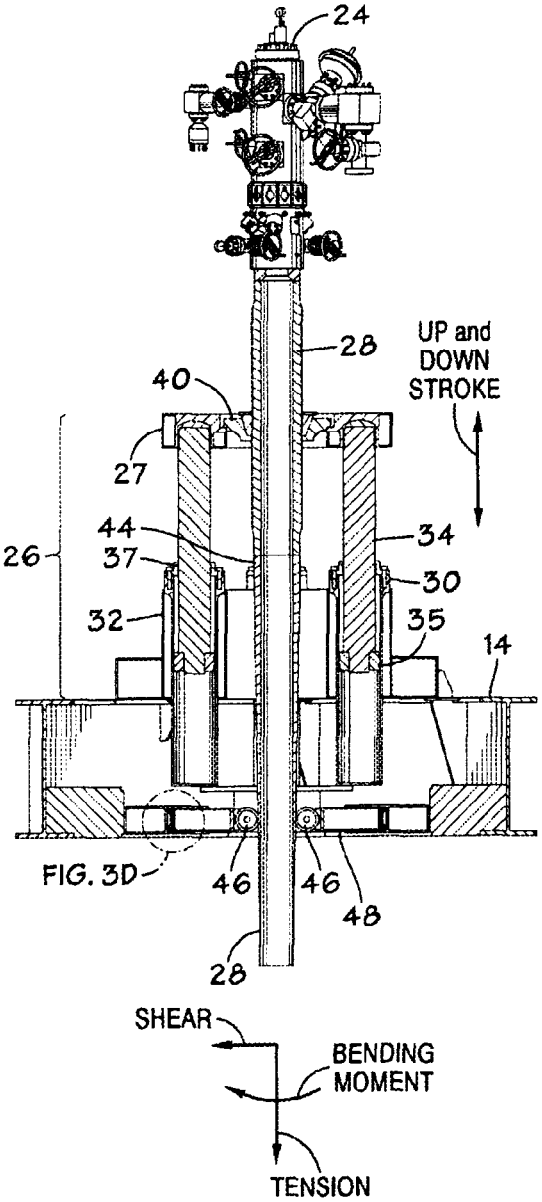
FIG. 3B is a cross-sectional view of the top-tensioned riser shown in FIG. 3A.
Figure 3D:
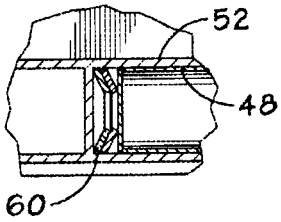
FIG. 3D is a detail view of the portion indicated in FIG. 3B.
Figure 3C:
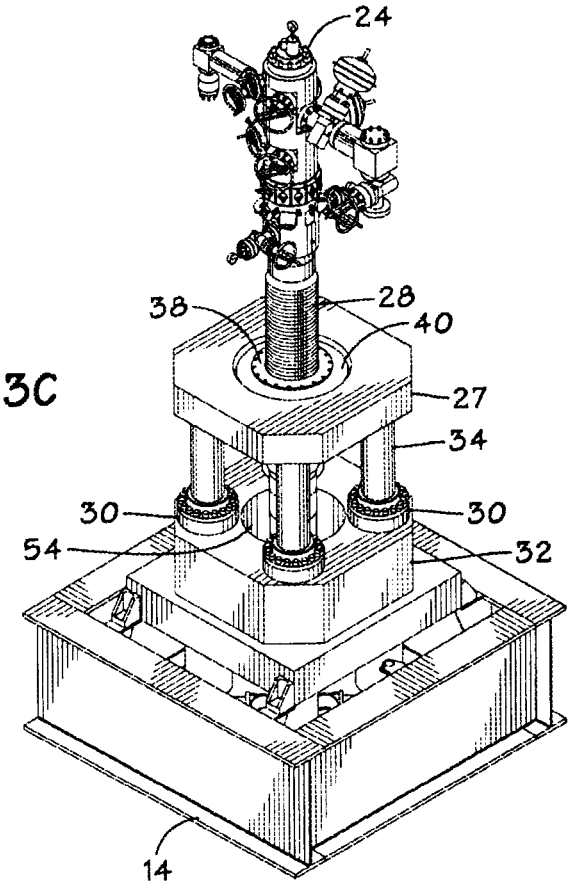
FIG. 3C is a perspective view of the top-tensioned riser shown in FIG. 3A.

As shown in FIGS. 2B and 3B, piston rods 34 may be equipped with seals 35 on their outer diameter at or near their lower ends (even if tensioner 26 uses ram-type, single-acting cylinders. Bearings at 35 may act to increase the resistance of piston rods 34 to bending loads imposed when they are collapsed into cylinders 30. Flange 37 at one end of the cylinder may contain and/or retain a rod seal and bearing.

FIGS. 2A, 2B and 2C show various views of a tension joint and threaded section of a subsea riser according to one embodiment of the invention. The tension joint comprises a tapered section—i.e., a portion of the tension joint whose outer diameter decreases with increasing distance from the top of the tension joint. As is conventional, the internal diameter of tension joint 28 may be constant—i.e., the wall thickness of the riser varies in at least the tapered portion 44 of the tension joint.

Also shown in FIGS. 2A, 2B and 2C is a portion of lower deck structure 14 of offshore platform 10 which portion has one or more openings through which the top-tensioned risers (TTR) 18 may pass. Central opening 54 in tensioner lower frame 32 is aligned with an opening in lower deck 14 and may be sized to accommodate tie-back connector 23 on the lower end of riser 18.

As shown in FIG. 2E, an externally threaded (or grooved) section 36 is connected to (or formed in) the upper end of the tension joint 28 and an internally-threaded ring 38 engages the treaded section at a selectable height above the deck structure to provide adjustment means for varying the contact point of the tensioner and the riser. Ring 38 bears against flexible tension ring 40 which transfers the tension load to tensioner upper frame 27. Ring 38 is also known as a space-out adapter. In certain embodiments, ring 38 may be segmented—e.g., comprised of separately insertably halves. As is also illustrated in FIG. 2E, flexible tension ring 40 may include a bonded elastomer element 42 to provide a degree of flexibility in the mounting. This flexibility may act to relieve a portion of the stresses imposed by platform motion and thereby permit a reduction in the required stiffness [or strength] of lower deck structure 14.

In the illustrated embodiment, a ram-style (or "push-up") tensioner 26 acts between the lower deck structure 14 of the offshore platform 10 and the tension ring 40. In one particular preferred embodiment, the tension ring 40 is a flex bearing comprised of bonded elastomer 42 between upper portion 40 and lower portion 40' to accommodate limited angular displacement and/or small lateral displacements of the tension ring 40 relative to the tensioner 26 (see FIG. 2E). Alternatively, tension ring 40 may comprise a spherical bearing to allow small angular displacements relative to the tensioner upper frame 27.

In a "dry-tree" offshore platform, a drilling riser may have a blowout preventer on the upper end of the riser. A production riser may have a "Christmas tree" on its upper end. In FIGS. 2 and 3, this is indicated as "Surface Equipment." Angular displacement of the riser relative to the platform causes such equipment mounted on the top of the riser to move substantially laterally relative to the platform as the riser pivots about its upper support point. In the past, certain offshore platforms have employed keel joints to limit the movement of surface equipment on the upper end of risers. This, in turn, may require the platform to have costly additional structure which may adversely affect the hydrodynamic properties of the platform.

The present invention provides the motion-limiting function of a keel joint for a top-tensioned riser system without the need for a keel joint.

In the past, ram-type tensioning systems have not been used to support a top-tensioned riser (TTR) without a keel joint. Conventional pull-up tensioning systems usually position rollers above the tension ring and require no keel joint. The TTR pivots around the rollers.

A riser system according to the invention may use a ram-style, push-up riser tensioner 26. Most tensioner systems are installed on the production or drilling deck 15 of an offshore platform 10. This requires sufficient strength in the deck structure to support the system. In contrast, a ram-style tensioner may be installed onto the hull of the platform with a conductor system such that the deck does not have to be designed to support the tensioners. Alternatively, the push-up tensioner 26 may be installed on lower deck 14 of a two-deck platform (such as illustrated in FIG. 1 as 10)

Arrows near the bottom of FIGS. 2B and 3B show the direction of shear and tension forces acting on the riser as well as the bending moment when the riser is laterally offset from its nominal position relative to the platform.

The rollers may be attached directly to the platform structure 14. In certain embodiments, there may be a gap between the rollers 46 and the outer surface of tapered section 44 of the tension joint 28 when the riser 18 is centered in the opening in the deck through which it passes. In other embodiments, the roller supports may be supported on roller support arms 48 which are spring-loaded (see FIGS. 2D and 3D) such that opposing rollers may remain in contact with the tapered section of the tension joint. A plurality of rollers 46 may be provided—either in opposing pairs or in arrays comprising an odd number of rollers.

Spring housing 52 may be generally square in cross section to prevent rotation of a similarly configured roller support arm 48 which may slide partially within spring housing 52.

The springs may comprise coiled springs 50, Belleville springs 60, gas springs or struts, elastomeric (e.g., rubber) springs or any other suitable form of force-applying device. In still other embodiments, the rollers 46 may be fabricated from or comprise an elastic material (e.g., polyurethane) such that rollers 46 may themselves be compressed as their contact point moves to a portion of the tension joint 28 having a larger outer diameter or riser 18 moves laterally with respect to platform 10.

FIGS. 3A, 3B, 3C and 3D show various views of another embodiment of the invention. In this embodiment, the rollers 46 which contact the outer surface of the tapered portion 44 of tension joint 28 are biased inward (against the surface of the tension joint) with Belleville springs 60 (see FIG. 3D).

A Belleville spring (also known as a coned-disc spring, conical spring washer, disc spring, Belleville washer or cupped spring washer) is a type of spring shaped like a washer. It typically has a frusto-conical shape which gives the washer a spring characteristic.

Belleville springs may be used to apply a pre-load to a bearing.

Some properties of Belleville springs include: high fatigue life, better space utilization, low creep tendency, high load capacity with a small spring deflection and the possibility for high hysteresis (damping) by stacking several Belleville springs on top of each other in the same direction.

Multiple Belleville springs may be stacked to modify the spring constant or amount of deflection. Stacking in the same direction will add the spring constant in parallel, creating a stiffer joint (with the same deflection). Stacking in an alternating direction is the equivalent of adding springs in series, resulting in a lower spring constant and greater deflection. Mixing directions allow a specific spring constant and deflection capacity to be designed.

Figures 4A, 4B:
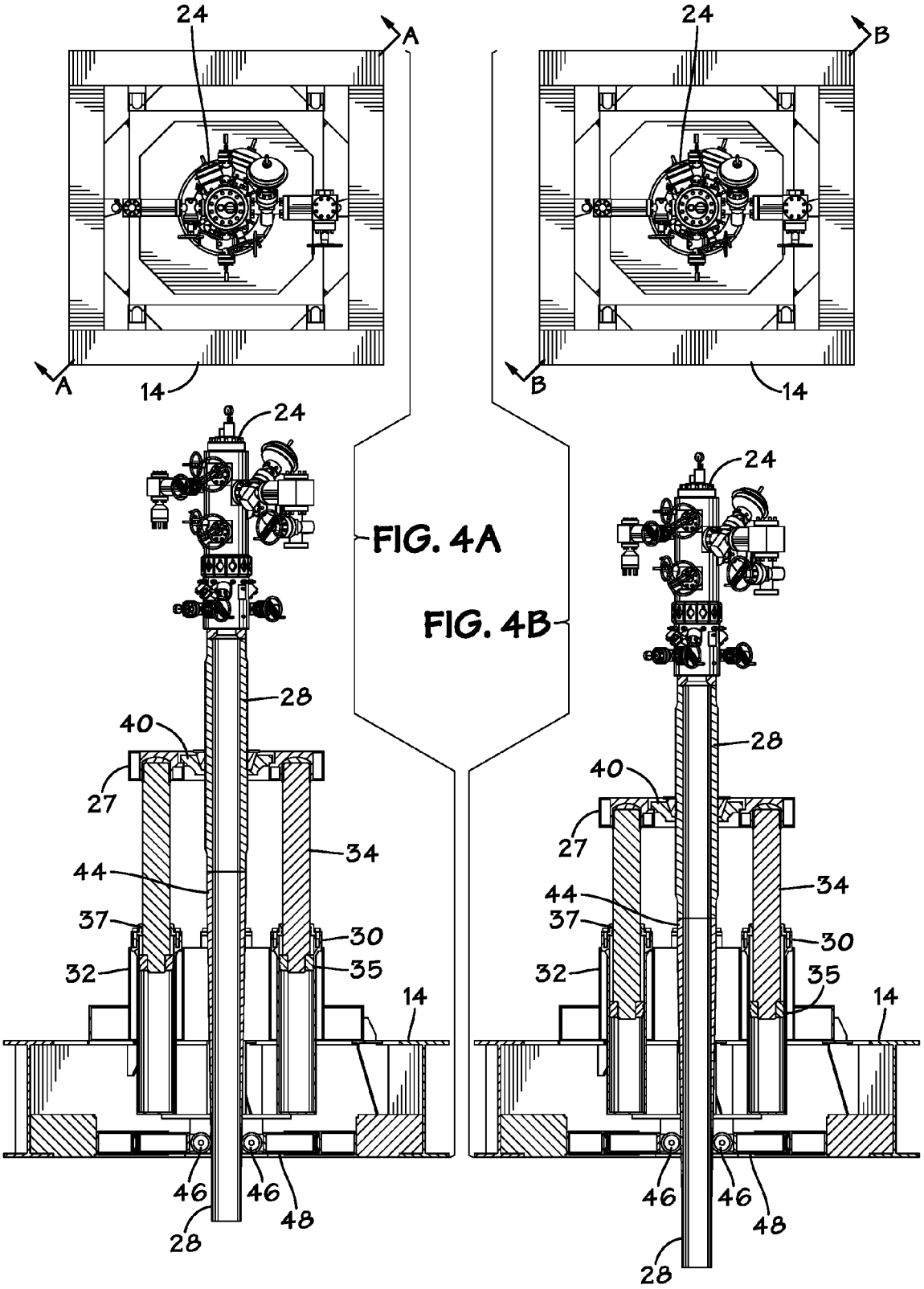
FIG. 4A shows top plan and sectional views of an embodiment of the invention with the production riser tensioner rams in the fully extended position.
FIG. 4B shows top plan and sectional views of an embodiment of the invention with the production riser tensioner rams in their nominal position.

FIGS. 4A through 4C show top plan and cross-sectional views of the embodiment of FIG. 3 with the production riser tensioner (PRT) piston rods 34 in three different states.

In FIG. 4A, the piston rods 34 of PRT 26 are fully extended and the rollers 46 are contacting the portion of tapered section 44 of tension joint 28 having the smallest outside diameter.

In FIG. 4B, the piston rods 34 of PRT 26 are in their nominal position—i.e. that which obtains when the platform 10 is in calm water and has zero offset from its intended location (θ=zero in FIG. 1). In this condition, the rollers are contacting a portion of the tapered section 44 of the tension joint 28 having an intermediate outside diameter.

In FIG. 4C, the piston rods 34 of PRT 26 are fully retracted—as might occur when the platform heaves upward on an ocean swell. In this condition, the rollers 46 are contacting a portion of the tapered section 44 of the tension joint 28 having a larger outside diameter and the rollers 46 therefore apply a greater aligning force to the riser tension joint 28.

In certain embodiments, the external ends of piston rods 34 may have spherical ends. This configuration may act to permit a small angular displacement between piston rods 34 and tensioner top plate 27.

Advantages and benefits of the invention over existing systems include the following:

a) The tension joint tapered section 44 may be used to resist bending moment and shear.

b) The tension joint tapered section 44 reduces the length of the straight section of the tension joint, and hence the overall length and cost.

c) Roller support reduces surface equipment movement, and hence well bay spacing requirements.

d) The tension joint tapered section 44 and roller support replace the need for a keel joint.

e) The tapered section 44 and roller 46 stiffness may be engineered to reduce the size of the tension joint 28 and maximize its efficiency while minimizing the loads that must be supported by deck structure 14.

f) As the riser 18 strokes down, the tension and bending moment increases. The roller 46 naturally reacts at a thicker section of the taper.

g) The configuration reduces the loads in the tension joint 28 and tensioning system.

h) The invention is particularly advantageous for Tension Leg Platforms (TLP's) and semi-submersibles having only two, primary decks and long stroke range, and hull constructions that do not economically provide a keel joint interface.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A top-tensioned riser system comprising:

a subsea riser having a tension joint on a upper portion thereof, at least a portion of the tension joint having a tapered outer diameter;

a riser tensioner connected at a first end to an upper portion of the tension joint and configured for attachment to a deck structure of an offshore platform at a second, opposing end;

at least two rollers proximate the outer surface of a lower portion of the tension joint such that lateral motion of the lower portion of the tension joint causes the portion of the tension joint having a tapered outer diameter to bear against at least one roller, wherein the rollers are mounted on roller support arms configured for attachment to the deck structure of the offshore platform such that they extend radially toward the riser tension joint from the platform deck structure and are biased by a resilient element that comprises a coil spring towards the riser tension joint.

2. The top-tensioned riser system of claim 1 wherein the rollers comprise an elastomer.

3. The top-tensioned riser system of claim 1 wherein the rollers comprise polyurethane.

4. The top-tensioned riser system of claim 1 wherein the riser tensioner is a push-up tensioner.

5. The top-tensioned riser system of claim 1 further comprising:

a tension ring having a central axial opening through which the tension joint passes and comprising a first upper metal section;

a second lower metal section; and, an intermediate elastomer section between the upper section and the lower section.

6. A top-tensioned riser system comprising:

a subsea riser having a tension joint on a upper portion thereof, at least a portion of the tension joint having a tapered outer diameter;

a riser tensioner connected at a first end to an upper portion of the tension joint and configured for attachment to a deck structure of an offshore platform at a second, opposing end;

at least two rollers proximate the outer surface of a lower portion of the tension joint such that lateral motion of the lower portion of the tension joint causes the portion of the tension joint having a tapered outer diameter to bear against at least one roller, wherein the rollers are mounted on roller support arms configured for attachment to the deck structure of the offshore platform such that they extend radially toward the riser tension joint from the platform deck structure and are biased by a resilient element that comprises a Belleville spring towards the riser tension joint.

7. The top-tensioned riser system of claim 6 wherein the resilient element comprises a plurality of stacked Belleville springs.

8. A top-tensioned riser system comprising:

a subsea riser having a tension joint on a upper portion thereof, at least a portion of the tension joint having a tapered outer diameter;

a riser tensioner connected at a first end to an upper portion of the tension joint and configured for attachment to a deck structure of an offshore platform at a second, opposing end;

at least two rollers proximate the outer surface of a lower portion of the tension joint such that lateral motion of the lower portion of the tension joint causes the portion of the tension joint having a tapered outer diameter to bear against at least one roller, wherein the rollers are mounted on roller support arms configured for attachment to the deck structure of the offshore platform such that they extend radially toward the riser tension joint from the platform deck structure and are biased by a resilient element that comprises an elastomer towards the riser tension joint.

9. The top-tensioned riser system of claim 8 wherein the elastomer is rubber.

* * * * *